US005375288A

United States Patent [19]

Seagren

[11] Patent Number: 5,375,288

[45] Date of Patent: Dec. 27, 1994

[54] ROUND HEAD BROOM

[76] Inventor: Eric H. Seagren, 12647 Tallow Hill La., St. Louis, Mo. 63146

[21] Appl. No.: 131,089

[22] Filed: Oct. 1, 1993

[51] Int. Cl.[5] ..... A46B 3/10

[52] U.S. Cl. ..... 15/169; 15/143.1; 15/170; 15/171; 15/174; 15/175; 15/191.1; 15/204; 15/207.2

[58] Field of Search ..... 15/159.1, 168–171, 15/174, 175, 189, 191.1, 204, 207, 143.1, 207.2

[56] References Cited

U.S. PATENT DOCUMENTS

| | | | |
|---|---|---|---|
| 56,750 | 7/1866 | Hiss | 15/174 |
| 59,372 | 11/1866 | Early | 15/171 |
| 66,291 | 7/1867 | Bonney | 15/174 |
| 307,711 | 11/1884 | Fish | 15/169 |
| 351,098 | 10/1886 | Dessau | 15/169 |
| 785,463 | 3/1905 | Winnie | 15/169 |
| 1,070,630 | 8/1913 | Reeves | 15/207 |
| 1,688,318 | 10/1928 | Albright, Jr. | 15/204 |
| 3,535,727 | 10/1970 | McCaffray, Jr. | 15/168 |
| 3,805,313 | 4/1974 | Keating | 15/159.1 |
| 4,031,588 | 6/1977 | Leroy et al. | 15/171 |
| 4,120,115 | 10/1978 | Mushkin | 15/207 |
| 4,575,893 | 3/1986 | Rozier | 15/171 |

FOREIGN PATENT DOCUMENTS

| | | | |
|---|---|---|---|
| 603110 | 8/1978 | Canada | 15/168 |
| 554673 | 6/1923 | France | 15/175 |
| 2544977 | 11/1984 | France | 15/159.1 |
| 305803 | 5/1918 | Germany | 15/174 |
| 439460 | 1/1927 | Germany | 15/168 |
| 559727 | 9/1932 | Germany | 15/168 |
| 656533 | 2/1938 | Germany | 15/171 |
| 74320 | 1/1931 | Sweden | 15/174 |
| 142536 | 10/1953 | Sweden | 15/169 |
| 103195 | 1/1924 | Switzerland | 15/169 |

*Primary Examiner*—Mark Spisich
*Attorney, Agent, or Firm*—Heller & Kepler

[57] ABSTRACT

A broom specially designed for cleaning debris out of holes and cracks in asphalt and concrete prior to patching has a round broom head. The round head allows the broom to penetrate narrow holes and cracks resulting in more efficient and effective cleaning. The bristles are made of polypropylene and are similar to bristles used on street cleaners. A bristle band is free to move along the bundle of bristles, variably compacting the bristles for particular applications.

15 Claims, 4 Drawing Sheets

ROUND HEAD BROOM

BACKGROUND OF THE INVENTION

The present invention relates in general to a circular head broom, and pertains more particularly, to a circular head broom for cleaning out potholes and cracks in asphalt or concrete prior to patching or crack repair. The broom of this invention is an improvement over the conventional brooms and is particularly adapted for cleaning out potholes or cracks having v-shaped profiles.

With the conventional broom it is nearly impossible to remove all of the debris and loose material from a pothole or crack needing repair, particularly with an asphalt or similar patch material. The importance of removal of these debris is generally accepted by those skilled in the art. Essentially all loose debris including loose asphalt or concrete in the hole must be removed to insure a strong physical bond of the patch to the hole.

Traditional square head brooms are difficult to use for cleaning out potholes since the square head often will not fit into the hole to be cleaned. As a result of this difficulty the worker turns the broom sideways. In this position the broom has little downward force making cleaning inefficient and inadequate. It is difficult to dislodge loose asphalt or concrete with the conventional broom typically used for this purpose.

SUMMARY OF THE INVENTION

An object of the present invention is to provide a broom capable of efficient cleaning of v-shaped holes and cracks in asphalt or concrete to remove debris prior to patching.

It is a further object of the present invention to provide a broom whose head can penetrate a narrow crack or hole to allow a worker to apply downward force to dislodge and remove loose asphalt or concrete and other debris.

A further object of the present invention is to provide a broom with sturdy, durable bristles which will not break apart during use leaving bristle debris in the hole being cleaned.

Still a further object of the present invention is to provide a round broom head whose bristles can be variably compacted to fit certain applications.

Another object of the present invention is to provide an improved broom construction that has a generally cupped shaped member that is adapted to resist movement or displacement of the broom's bristles when force is applied on the broom during its intended use.

To accomplish the foregoing and other objects of the invention there is provided a circular head broom for removing debris from potholes and cracks prior to their repair. The broom includes bristles made of high density polypropylene, similar to bristles used for the rotating brushes of mechanized street sweepers. These bristles are selected for their strength and durability. The bristles are arranged to form a round bundle capable of penetrating narrow cracks and holes, and are attached by clamps to a long wooden broom handle.

In a preferred embodiment of the present invention, a PVC or polypropylene broom collar covers the clamps for protection and aesthetics. A metal bristle band, moveable along the bristle bundle is used to vary the compactness of the bristles at the free end of the bundle.

This-allows the diameter of the bristle head to be altered for specific applications.

These and other objects and features of the present invention will be better understood and appreciated from the following detailed description of preferred embodiments thereof, selected for purposes of illustration and shown in the accompanying drawings.

BRIEF DESCRIPTION OF THE DRAWINGS

FIG. 5 is a bottom view of broom, at the center of bristles bottom in which the bristles are not compacted by a bristle band and are therefore flared enough to let broom handle show through.

DETAILED DESCRIPTION

Figures 1, 2, 3:
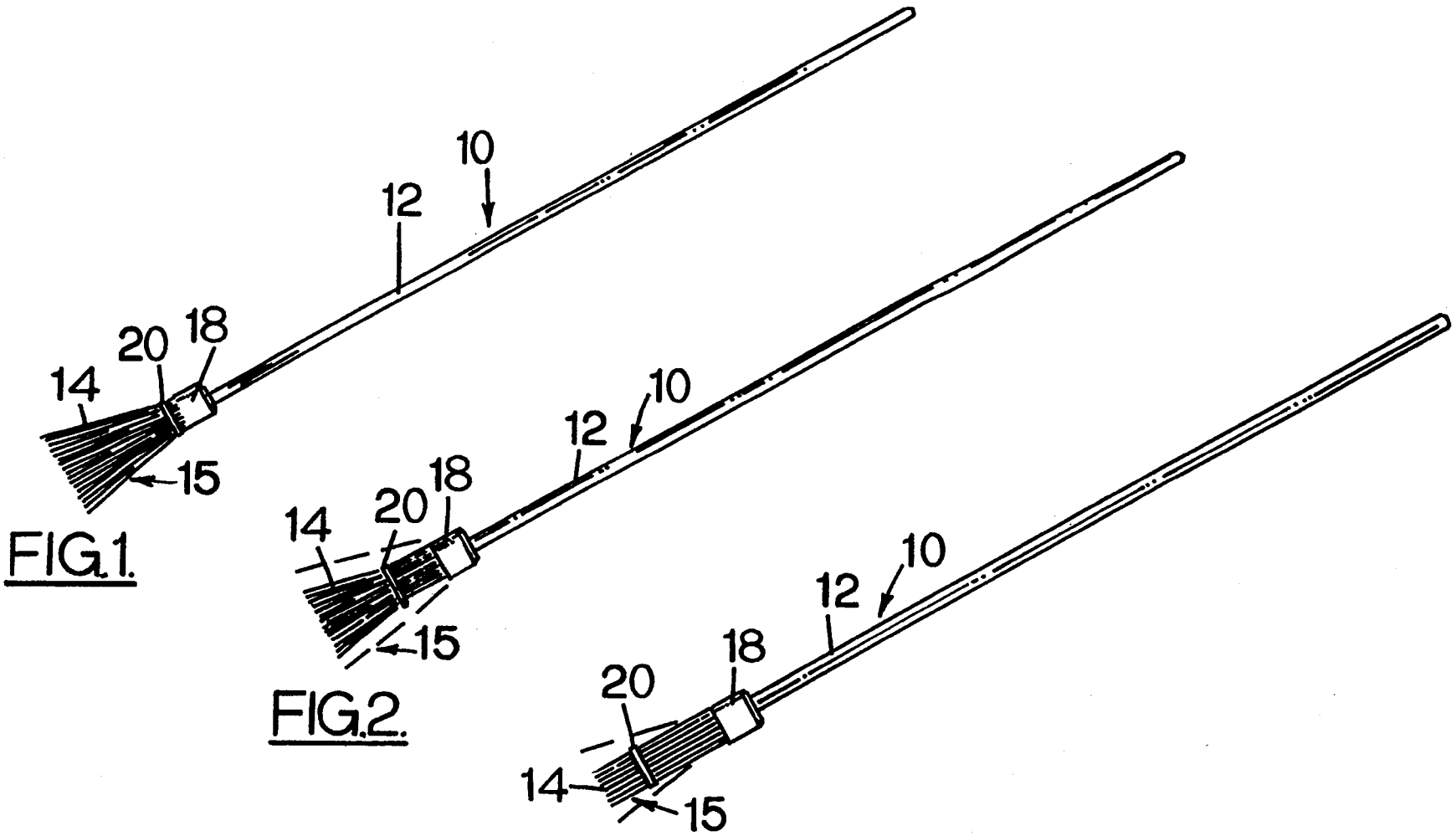
FIG. 1 is a view of the round headed broom with the bristle band in its uppermost position resting against the broom collar.
FIG. 2 is a view of the broom of FIG. 1 with the bristle band in a midway position along the bristles resulting in a smaller diameter at the free end of the bristle bundle.
FIG. 3 is a view of the broom of FIG. 1 with the bristle band at a low position on the bristles resulting in a compact bristle head.

Referring now to the drawings there is shown a preferred embodiment for the improved broom of this invention. The broom is described in connection with an asphalt or concrete road repair application to remove loose asphalt, concrete and debris from a pothole or crack before a patch material is applied to repair the pothole or crack.

The broom of the present-invention is particularly adapted for use in cleaning loose asphalt and other debris from a crack or pothole having a typical v-shaped profile common to and typically found in both the crack and the pothole. The broom of the present invention is characterized by an improved result due in part to the shape of the broom bristle bundle and the added ability to change the compactness and taper of the broom's bristles.

The drawings show the improved broom 10 in FIG. 1 including a relatively long wooden handle 12, preferably made of ash in view of its strength and durability when used in these and similar applications and preferably being at least five feet in length. In a preferred embodiment the broom bristles 14 are made of high density polypropylene and are commercially available as Orange Ripple Pro (14") from E. B. and A. C. Whiting Company, Burlington Vt. The bristles 14 are preferably 14 inches in length, and are arranged in a circular bundle 15 preferably 2.5 inches in diameter when fully compacted.

Figure 4:
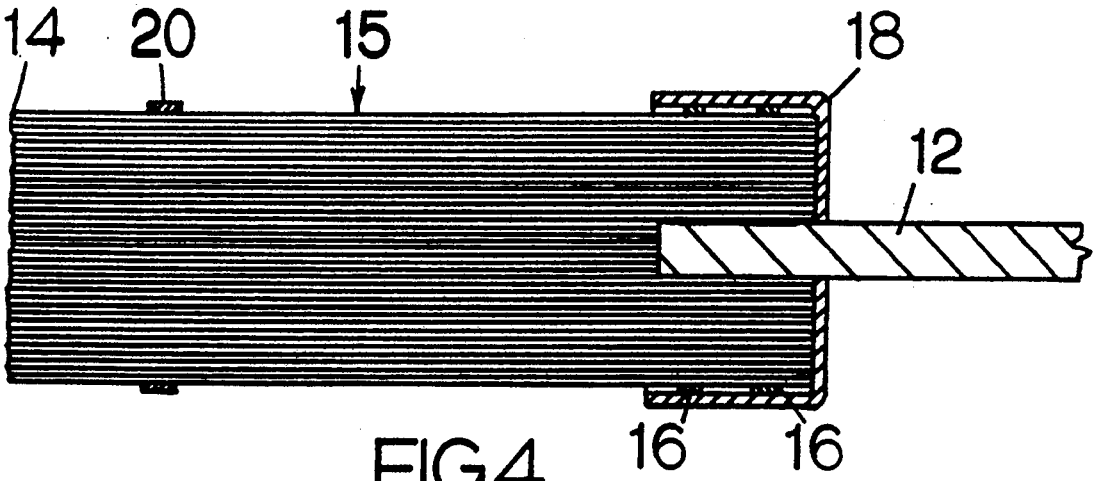
FIG. 4 is a cross-sectional view of the broom as shown in FIG. 3.
Figure 5:
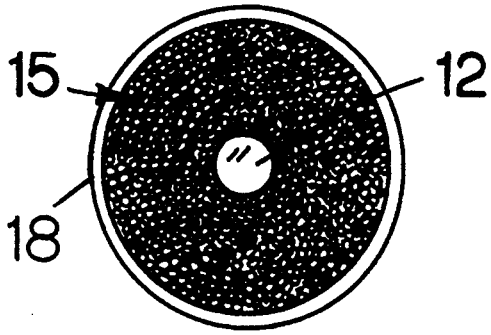
Figure 6:
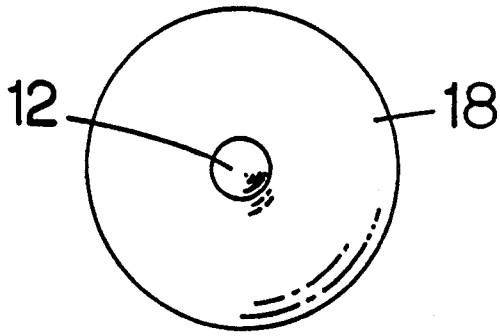
FIG. 6 is a top plan view of the broom of FIG. 1.

The bristle bundle 15 is attached to the end of the broom handle 12 by one or more clamps 16 as illustrated in FIG. 4. The use of band-type pipe clamps is presently preferred.

A PVC or polypropylene broom collar 18 protects the clamps and provides a finished look to the broom 10. A metal bristle band 20 or its equivalent is adjustable for being positioned along the bristle bundle 15 and is held in place by the outward pressure of the bristles 14 on the band 20.

In FIG. 1, the bristle band 20 is depicted in its uppermost position. In the uppermost position, the bristles 14 flare out at the free end of bundle 15, resulting in a larger diameter bundle end surface and a bristle bundle with the least relative stiffness.

In FIG. 2, the bristle band 20 is depicted in a position partly down the bristle bundle 15 towards the free ends of the bristles. Thus, it can be observed that the flare of the bristles 14 has been limited by the position of the collar relative to the bristles. This results in a relatively smaller diameter bristle bundle end surface.

FIG. 3 illustrates the bristle band 20 at a very low position on the bristle bundle 15. The bristles 14 are compacted on the free end of the bundle 15 to roughly the same diameter as the end of the bristles 14 clamped to the broom handle 12.

The aforementioned ability to vary the shape and diameter of the bristle bundle 15 and the end surface allows the worker to readily and simply customize the broom shape for each particular application.

The more compact the bristles 14, the smaller the end surface of the bristle bundle and the more downward force a worker will be able to apply to the hole when using the broom. This is accomplished by moving the collar closer to the free end of the bristles, thereby compacting the bristles and reducing the diameter of the bristle bundle.

Conversely, the bristle bundle 15 which is allowed to flare out results in a larger bundle 15 end for cleaning, but reduces the downward force a worker can apply to a hole since the bristles will have a greater tendency to bend in the latter example than they will in the former example.

Figure 7:
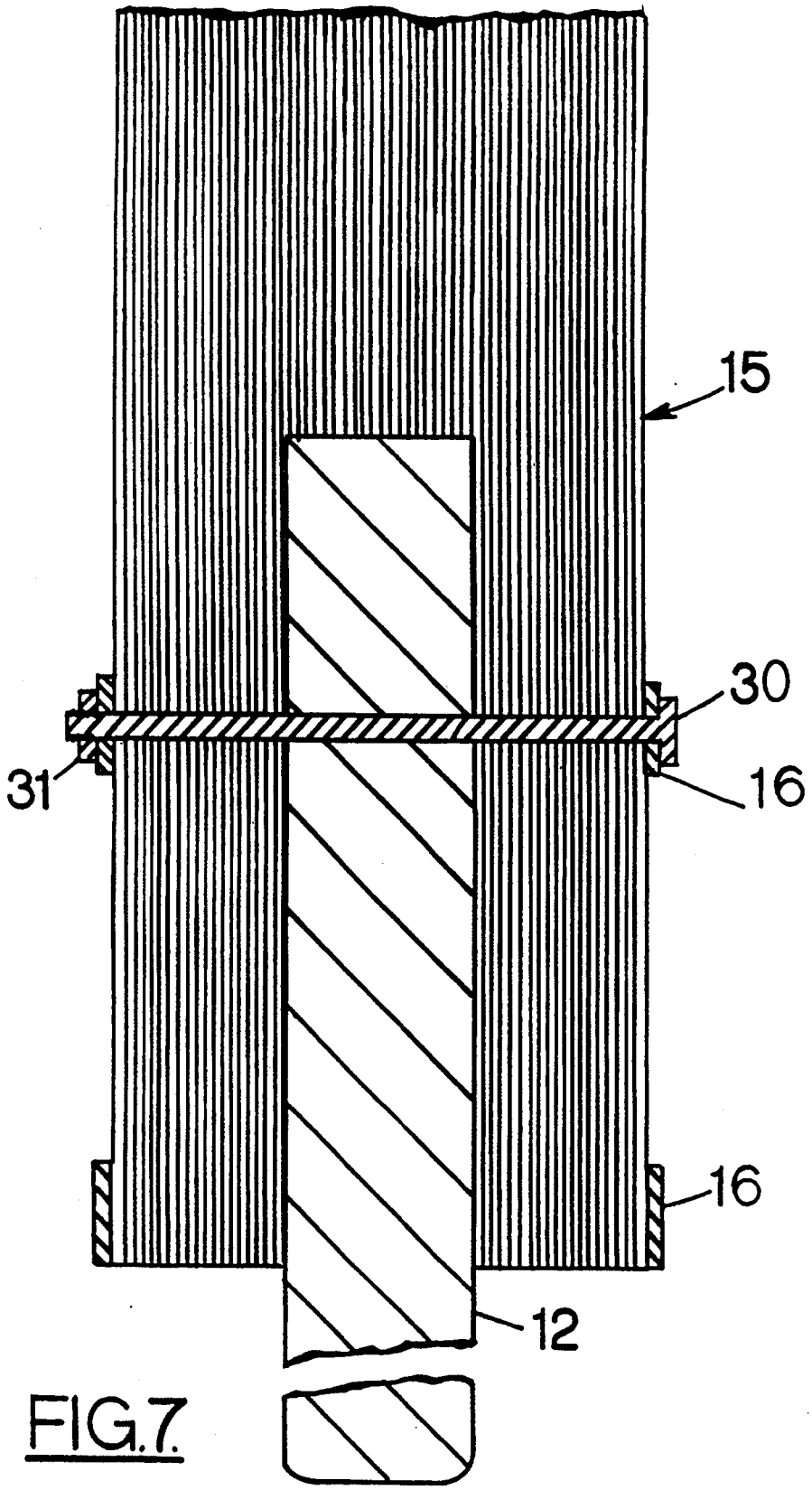
FIG. 7 is a cross-sectional view of one embodiment of the broom of the present invention.
Figure 8:
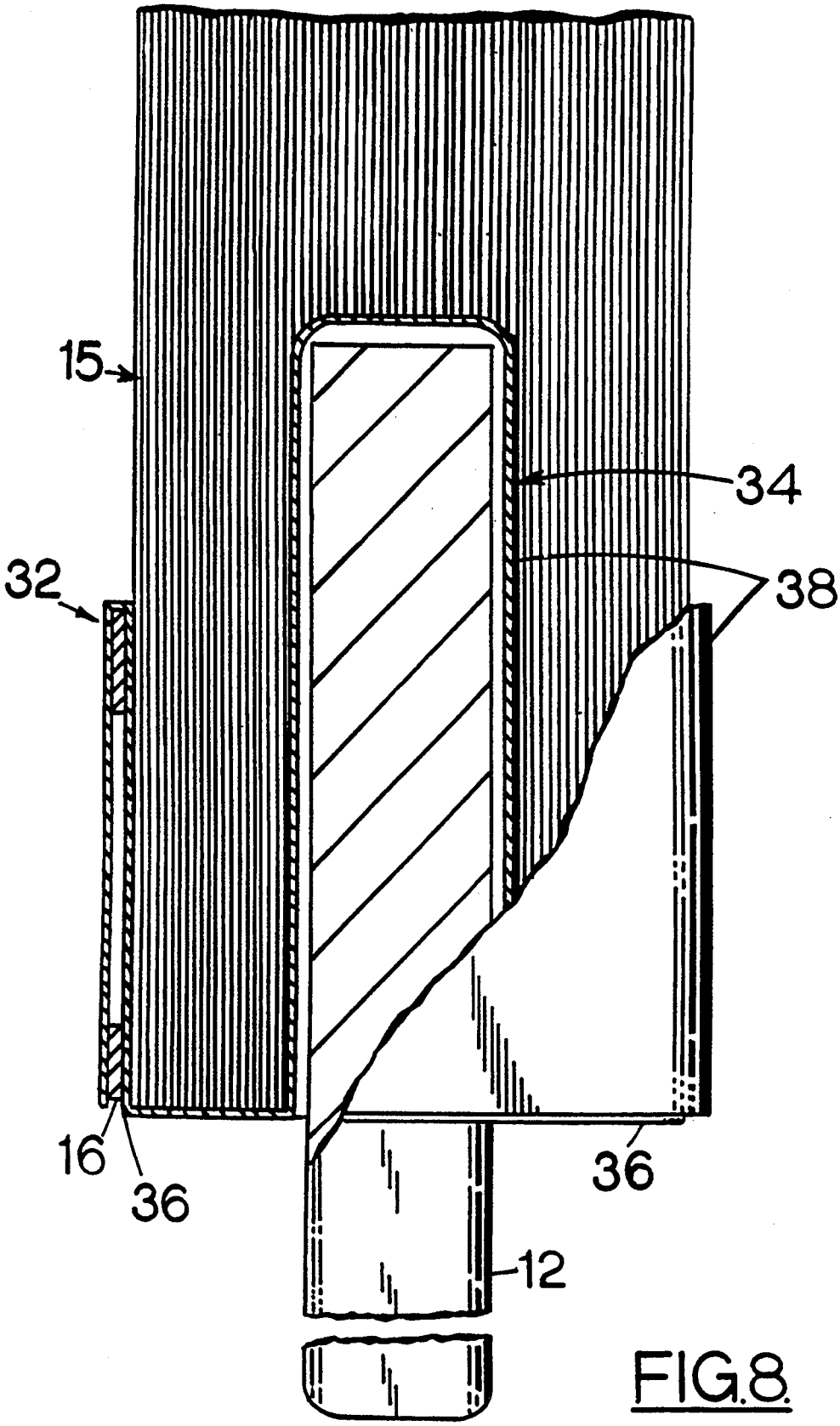
FIG. 8 is a cross-sectional view of another embodiment of the broom of the present invention.

FIGS. 7 and 8 illustrate two optional broom handle securing methods to prevent the broom handle 12 from moving further downward into the bristles 14 when force is applied. As shown in FIG. 7, a bolt 30 is inserted in the band clamp 16 and through the broom handle 12. The bolt 30 is secured by a nut.

FIG. 8 illustrates a handle securing method using a dual cupped molded piece 32 having an inner cup portion 34 and an outer cupped portion 36. The molded cup piece 32 is preferably made of polypropylene. The inner molded cup piece 34 is fitted over the broom handle 12 and securely taped in place before the bristles 14 are attached. The bristles 14 are then arranged within the outer cupped portion 36 and the clamps 16 are secured around both the bristles 14 and the molded cup 32 as illustrated in the drawing.

The broom collar 18 may then be added to protect the clamps and provide a finished look. In a preferred embodiment a heavy duty tape is wrapped around the cupped molded piece 32 so that the tape covers a substantial portion of the cup.

From the foregoing description those skilled in the art will appreciate that all of the objects of the present invention are realized.

A broom is provided which is capable of efficient cleaning of V-shaped holes and cracks in asphalt or concrete to remove debris prior to patching. The broom head of the present invention is capable of penetrating a narrow crack or hole to allow a worker to apply downward force to dislodge and remove loose asphalt, concrete and other debris.

Further, a broom is provided which is sturdy enough that the bristles will not break while in use further contributing to debris in the holes to be patched. Finally, this broom provides a variably compaction head to allow modification of the broom and the stiffness of the bristles and the bristle bundle for specific applications. This is accomplished with a movable band that increases bundle stiffness as its location is closer to the free end of the bundle.

An improved broom has been shown and described that is constructed to provide a generally cupped shaped member that adapted to resist movement or displacement of the broom's bristles when force is applied on the broom during its intended use.

While a specific embodiment has been shown and described, many variations are possible. The dimensions of the broom and its components are illustrative only and may be modified for a particular application. While a wooden broom handle is preferred, any suitable material can be used. The polypropylene bristles work particularly well in the present invention, but any bristle which is rigid and strong enough for the instant purposes could be used.

The bristles may be attached by any suitable means to the broom handle, and the collar means can be modified or dispensed with. Likewise, while its use is preferred, the bristle band means can be modified or dispensed with where modifications of the broom head size is not necessary or desired.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A broom for removing debris from holes and cracks comprising:

an elongated handle portion;

a plurality of stiff bristles arranged to form a bristle bundle having a generally circular end surface;

a dual cupped portion having an inner cupped portion which fits over and around the broom handle and an outer cup portion which fits over and around the bristle bundle, the bristle bundle being located in a space intermediate to and defined by the cupped portions; and means to connect the bristles and the cupped portion to the handle portion.

2. A broom as set forth in claim 1 wherein the handle portion is wood.

3. A broom as set forth in claim 1 wherein the bristles are made of polypropylene.

4. A broom as set forth in claim 1 wherein the means to connect the bristles and the cupped portion to the handle portion is a clamping device.

5. A broom as set forth in claim 1 wherein the dual cupped portion is plastic.

6. A broom for removing debris from holes and cracks, comprising:

an elongated wood handle;

a plurality of polypropylene bristles arranged to form a bristle bundle having a generally circular end surface;

a dual cupped portion having an inner cupped portion which fits over and around the broom handle and an outer cupped portion which fits over and around the bristle bundle, the bristle bundle being located in a space intermediate to and defined by the cupped portions; and means to connect the bristles and the cupped portion to the handle portion.

7. A broom as set forth in claim 6 wherein the wooden handle is made of ash wood.

8. A broom as set forth in claim 6 wherein the means to connect the bristles and the cupped portion to the handle is a clamping device.

9. A broom as set forth in claim 6 wherein the polypropylene bristles are approximately 14 inches in length.

10. A broom as set forth in claim 6 wherein the circular surface of the bristle bundle has a diameter of approximately 2.5 inches.

11. A broom as set forth in claim 6 further including a collar means to shield the means to connect the bristles to the handle portion.

12. A broom as set forth in claim 6 wherein the dual cupped portion is plastic.

13. An improved broom, comprising:

an elongated ash wood handle;

a plurality of approximately 14 inch long polypropylene bristles arranged to form a bristle bundle having a circular end surface of approximately 2.5 inch diameter;

a dual cupped plastic portion having an inner cupped portion which fits over and around the broom handle and an outer cupped portion which fits over and around the bristle bundle, the bristle bundle being located in a space intermediate to and defined by the cupped portions;

at least one band clamp to hold one end of the bristle bundle and the dual cupped portion in place at one end of the handle, whereby clamping the bristle bundle and the cupped portions in place prevents movement of the broom handle relative to the bristle bundle; and a collar means to shield the clamp holding the bristles and the dual cupped portion in place.

14. A broom as set forth in claim 13 further including a bristle guide capable of being placed at various positions along the bristle bundle whereby the compactness of the bristles at the end of the bristle bundle not attached to the handle may be varied.

15. A broom as set forth in claim 13 further including a bolt and nut to anchor the clamp to the handle.

* * * * *